US006401474B1

(12) United States Patent
Wigglesworth et al.

(10) Patent No.: US 6,401,474 B1
(45) Date of Patent: Jun. 11, 2002

(54) DAMPER ASSEMBLY FOR AIR CONDITIONING SYSTEM

(76) Inventors: Ira Lester Wigglesworth; Ira Lester Wigglesworth, Jr., both of 4475 NW. 36th Ave., Gainesville, FL (US) 32606

( * ) Notice: Subject to any disclaimer, the term of this patent is extended or adjusted under 35 U.S.C. 154(b) by 0 days.

(21) Appl. No.: 09/781,691

(22) Filed: Feb. 12, 2001

Related U.S. Application Data

(60) Provisional application No. 60/181,506, filed on Feb. 10, 2000, and provisional application No. 60/205,189, filed on May 18, 2000.

(51) Int. Cl.[7] ..... F25D 23/12; F25B 39/04
(52) U.S. Cl. ..... 62/259.1; 62/507
(58) Field of Search ..... 62/259.1, 507

(56) References Cited

U.S. PATENT DOCUMENTS 4,730,423 A * 3/1988 Hughes et al. ..... 52/173 R
4,745,769 A * 5/1988 Wooden ..... 62/259.1
4,815,530 A * 3/1989 Scott ..... 165/134.1
5,097,678 A * 3/1992 Aubuchon ..... 62/506
5,660,054 A * 8/1997 Rice ..... 62/259.1
6,186,158 B1 * 2/2001 Goarin ..... 135/128
6,221,120 B1 * 4/2001 Bennington et al. ..... 55/385.1

* cited by examiner

*Primary Examiner*—William C. Doerrler
(74) *Attorney, Agent, or Firm*—Holland & Knight LLP

(57) ABSTRACT

A damper assembly for use in conjunction with a conventional air conditioning system. The damper assembly includes a flexible damper which has a configuration and dimension to cover the grillwork of the air conditioning system. The damper further includes a centrally located magnet which allows it to be magnetically coupled to the grillwork. When the air conditioning system is not in operation the damper is caused to cover the grillwork and thereby prevent debris from falling into the blower assembly. When the air conditioning system is in operation. the periphery of the damper is caused to blow upwardly by way of air passing through the blower assembly. When this occurs, the magnet functions to keep the damper secured to the grillwork. In this manner, the damper does not preclude air flow from the blower assembly during normal air conditioning operation.

6 Claims, 3 Drawing Sheets

DAMPER ASSEMBLY FOR AIR CONDITIONING SYSTEM

CROSS-REFERENCE TO RELATED APPLICATIONS

This application claims the benefit of the provisional application entitled "Air and Heat Exhaust Vent Closure", application Ser. No. 60/181,506, filed Feb. 10, 2000 and the provisional application entitled "Air and Heat Exhaust Vent Closure", application Ser. No. 60/205,189, filed May 18, 2000, the disclosures of which are hereby incorporated by reference herein.

FIELD OF THE INVENTION

This invention relates to heating and air conditioning units. More particularly, this invention relates to dampers that may be used in conjunction with outdoor heating and air conditioning systems to prevent debris from entering into the outdoor housing containing the heating or air conditioning system.

DESCRIPTION OF THE BACKGROUND ART

Presently, conventional heating and air conditioning systems are in widespread use throughout the world. Typically, air conditioning systems comprise an outdoor housing containing a compressor and a condenser. An air handling unit, comprising a fan protected by suitable grillwork, functions to draw outside air across the condenser into the housing to exit the housing from the upper surface thereof. The protective grillwork prevents large objects from inadvertently falling into the housing via the protective grillwork.

Unfortunately, the protective grillwork is typically comprised of a metal grill with spacings that are spaced apart to such a degree that debris, such as leaves, pine needles. acorns, pollen, etc. may pass through the grillwork and fall into the air conditioning housing. The air conditioning housing is particularly susceptible to contamination by such debris when the system is not operating. Specifically, when the system is not operating to produce the upward flow of air from inside the housing, even lightweight debris may easily pass through the grillwork and fall into the housing. Therefore, there presently exists a need for covering the grillwork to prevent debris from falling into the housing when the air conditioning system is not operating. Louvered shutters. mechanical dampers and similar devices have not proven to be commercially viable due to their tendency to adversely restrict the upward airflow during operation of the air conditioner.

Known prior art involving dampers include the following: U.S. Pat. No. 3,401,624; U.S. Pat. No. 3,472,150; U.S. Pat. No. 3,788,207: U.S. Pat. No. 3,895,568; U.S. Pat. No. 3,942,422: U.S. Pat. No. 4,036,120; U.S. Pat. No. 4,336,749 and U.S. Pat. No. 6,031,717, the disclosures of which are hereby incorporated by reference herein.

Of particular relevance to the subject invention is U.S. Pat. No. 3,472,150 entitled "Self-Closing Flexible Damper". In this type of damper, a flexible member is affixed at its center to a cross-support positioned above the fan blades of a circulating exhaust fan.

U.S. Pat. No. 3,401,624 entitled "Air Exhauster With Damper Means" discloses an exhaust fan having a flexible damper with a center hole that rides up a guide shaft due to the air pressure created by the air flow, yet returns to a lowered sealed position when the air flow created by the circulating fan ceases operation.

Due to their complexity, the above-referenced prior art dampers are not readily adaptable to housings of conventional air conditioning systems. Therefore, a need still exists for a simplified damper that may be positioned over the grillwork of an outdoor housing of an air conditioning system.

Therefore, it is an object of this invention to provide an improvement which overcomes the aforementioned inadequacies of the prior art devices and provides an improvement which is a significant contribution to the advancement of the air conditioning damper art.

Another object of this invention is to provide an outdoor housing of an air conditioning system with a damper that automatically closes about the grillwork of the circulating fan when the circulating fan ceases operation, thereby preventing debris such as leaves, pine needles, acorns, pollen, etc. from falling through the grillwork and contaminating the inside of the housing.

Another object of this invention is to provide a damper for covering the grillwork of an outdoor housing of an air conditioning system that is simple, economical to manufacture and easy to install without any special expertise or tools.

Another object of this invention is to provide an automatic damper to cover the upper grillwork of an outdoor housing of an air conditioning system that is not permanently affixed to the housing thereby allowing it to be easily installed and removed as desired.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention. this invention comprises a damper for outdoor air conditioning housings. More particularly, the damper of the invention comprises a sheet of flexible material, such as fiberglass screening, which is configured and dimensioned to cover the upper grillwork of an outdoor air conditioning housing containing an air conditioning compressor and condenser. In one embodiment, the damper is removably affixed to the grillwork by means of a magnet that is positioned in the center of the damper to magnetically couple the damper to the center of the grillwork. During operation of the blower assembly contained within the housing, the blower assembly draws air across the condenser coils of the air conditioner around the sides of the housing whereupon the air flow is then directed upwardly to pass through the grill work. The air flow passing through the grillwork creates pressure on the underside of the damper causing its periphery to move upwardly thereby allowing the air flow to escape upwardly. In this regard, it is noted that the magnet securely retains the center of the damper to the center of the grillwork to prevent the damper from being blown entirely off of the grillwork or otherwise becoming decentered relative to the grillwork. As the blower assembly ceases operation, the air flow created thereby likewise ceases and the peripheral edges of the damper gently fall downwardly by gravity to cover the grillwork.

In another embodiment of the damper assembly of the invention, an upstanding rod is fitted to the magnet and a suitable coupling and the magnet is magnetically coupled to the center of the grillwork of the outdoor housing. A flexible damper, likewise containing a configuration and size sufficient to cover the grillwork, is provided with a center hole. During assembly, the center hole of the damper is aligned with the upstanding rod and is allowed to slide down the upstanding rod to cover the grillwork. A stop is then fitted to the upstanding end of the upstanding rod. During operation of the blower assembly, air flow through the condenser coils is forced upwardly whereupon the flexible damper gently rises by sliding upwardly along the length of the upstanding rod. The peripheral edges of the flexible member likewise flutter upwardly as in the case of the first embodiment. When the blower assembly ceases operation and the ail flow stops, the flexible member gently drifts downwardly along the length of the upstanding rod to cover the grillwork. Debris and other contaminants are therefore prevented from falling into the housing through the grillwork. It should be appreciated that in connection with each embodiment of the invention, the flexible damper always remains centered relative to the grillwork and gently returns to cover the grillwork as soon as the air flow ceases when the blower assembly is turned off. It should also be appreciated that the flexible nature of the damper, including the capability for its peripheral edges to flutter upwardly, significantly precludes any adverse restriction of the upward airflow during operation. Indeed, restriction of such air flow is virtually eliminated altogether in the case of the second embodiment of the invention wherein the flexible damper is allowed to drift upwardly a considerable distance (e.g., two feet) above the grillwork during operation of the air handler.

Finally, it should be appreciated that both embodiments are merely magnetically coupled to the grillwork of the air conditioning housings. Thus, they may be easily installed and easily removed without tools.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention. reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
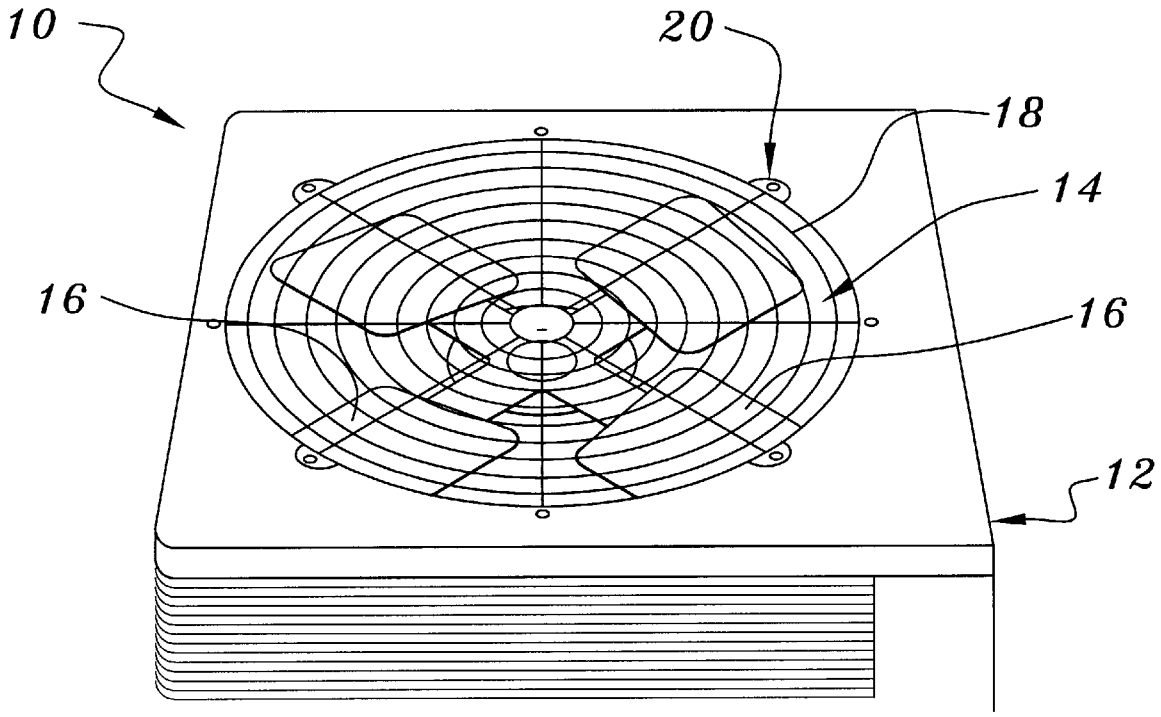
FIG. 1 is an upper perspective view of a conventional outdoor air conditioning housing showing the blower assembly that exhausts air upwardly from the housing with the blower assembly being protected by an outer grillwork.

As shown in FIG. 1, a conventional air conditioning system 10 is enclosed within a housing 12. Positioned within the housing 12 is a blower assembly 14 including a plurality of fan blades 16 that are rotated by means of a motor (not shown) to cause a flow of air through the sides of the housing 12 across the coils of a condenser and then upwardly to exit the housing 12. A grillwork 18 is positioned over the blower assembly 14 by means of fasteners 20 to protect the rotating fan blade 16 from falling debris as well as to serve as a safety feature to prevent children from being harmed by the rotating fan blade 16. A center plate 22 is composed of a ferris metal.

Figure 2:
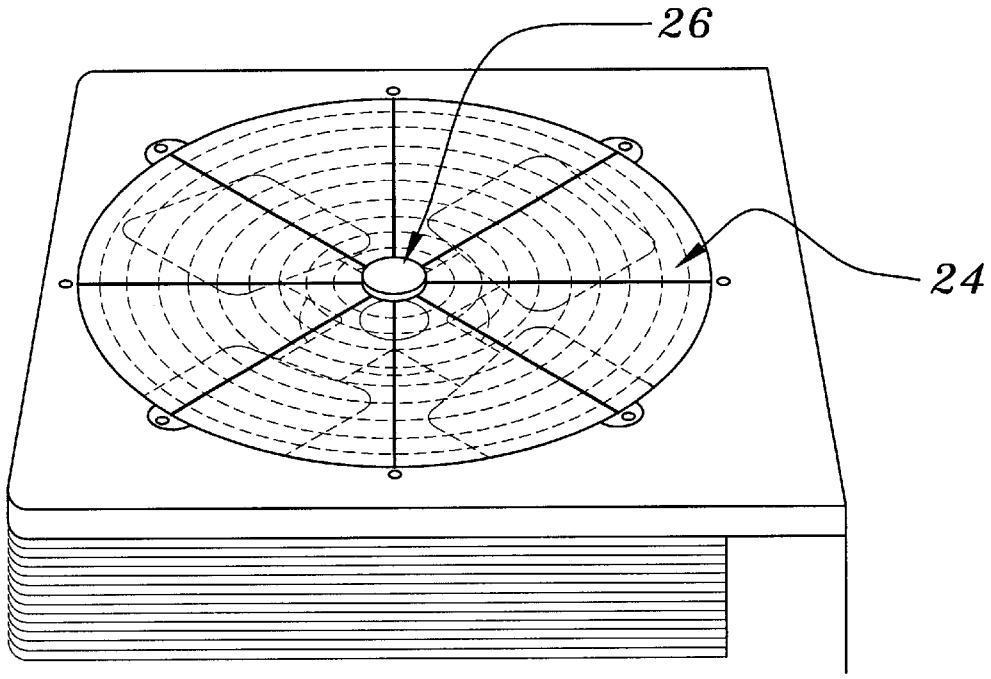
FIG. 2 is an upper perspective view of FIG. 1 with the first embodiment of the damper magnetically coupled thereto by means of a center magnet.

As shown in FIG. 2, the first embodiment of the invention comprises a flexible damper 24 sheet having a configuration and dimension substantially equal to the configuration and dimension of the grillwork 18 so as to fully cover the grillwork 18. Damper 24 is preferably comprised of a flexible material such as a flexible fiberglass or plastic material. Conventional fiberglass screening material has been found to be most suitable. Damper 24 is secured into position in alignment with the grillwork 18 by means of a disk-shaped magnet 26 that is positioned in the center of the damper 24 in alignment with the center plate 22 of the grillwork 18. The magnet 26 magnetically couples damper 24 to the center plate 22 due to the magnetic attraction between the magnet 26 and the center plate 22 composed of a ferris material. As shown in FIG. 2, damper 24 serves to fully cover the grillwork 18 and prevent debris from falling through the grillwork 18 into the housing 12.

Figure 3:
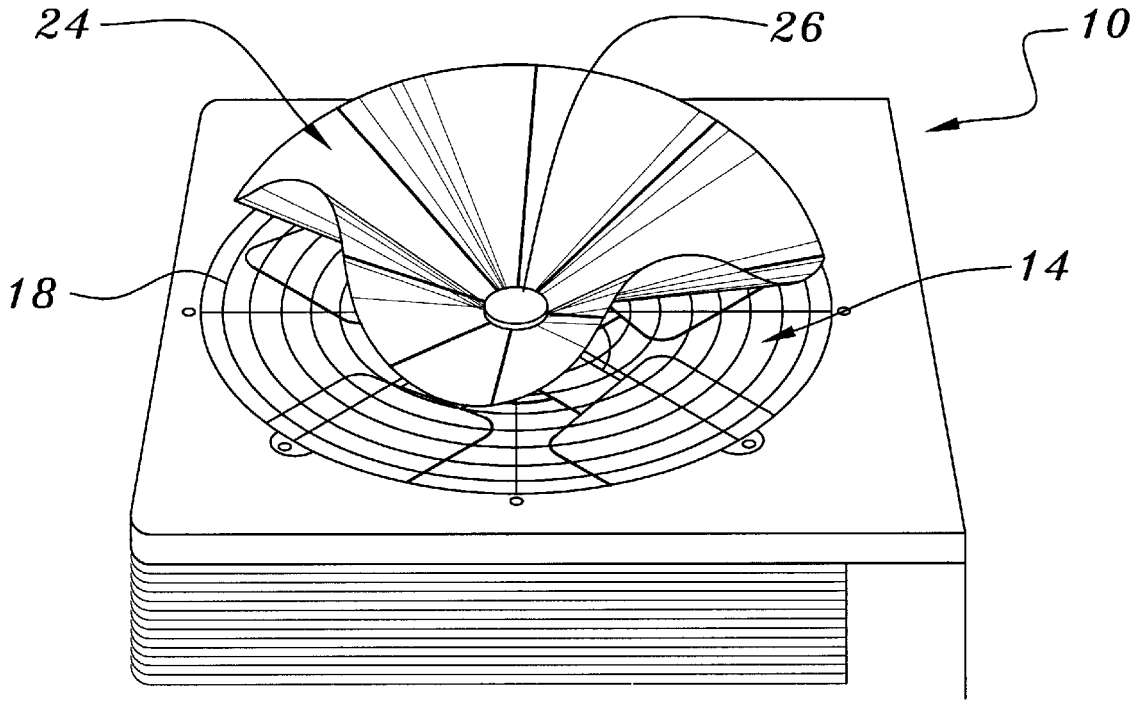
FIG. 3 is an upper perspective view of FIG. 2 showing the upward fluttering of the air damper of the invention during operation of the blower assembly.

As shown in FIG. 3, when the blower assembly 14 is in operation causing an upward air flow through the grillwork 18, the air flow exerts a force on the underside of the damper 24 causing its periphery 28 to flex or flutter upwardly to allow the air flow to escape without adversely affecting such air flow. The magnet 26, being positioned in the center of the damper 24 and thereby being magnetically coupled to the center plate 22, serves to magnetically couple the center of the damper 24 to the center plate 22 and thereby prevent the damper 24 from being blown off of the grillwork 18 or otherwise becoming uncentered relative to the grillwork 18. As soon as the blower assembly 14 ceases operation and the upward air flow likewise ceases, the periphery 28 of the damper 24 settles downwardly by gravity to return to its sealing position over the grillwork as shown in FIG. 2.

Figure 4:
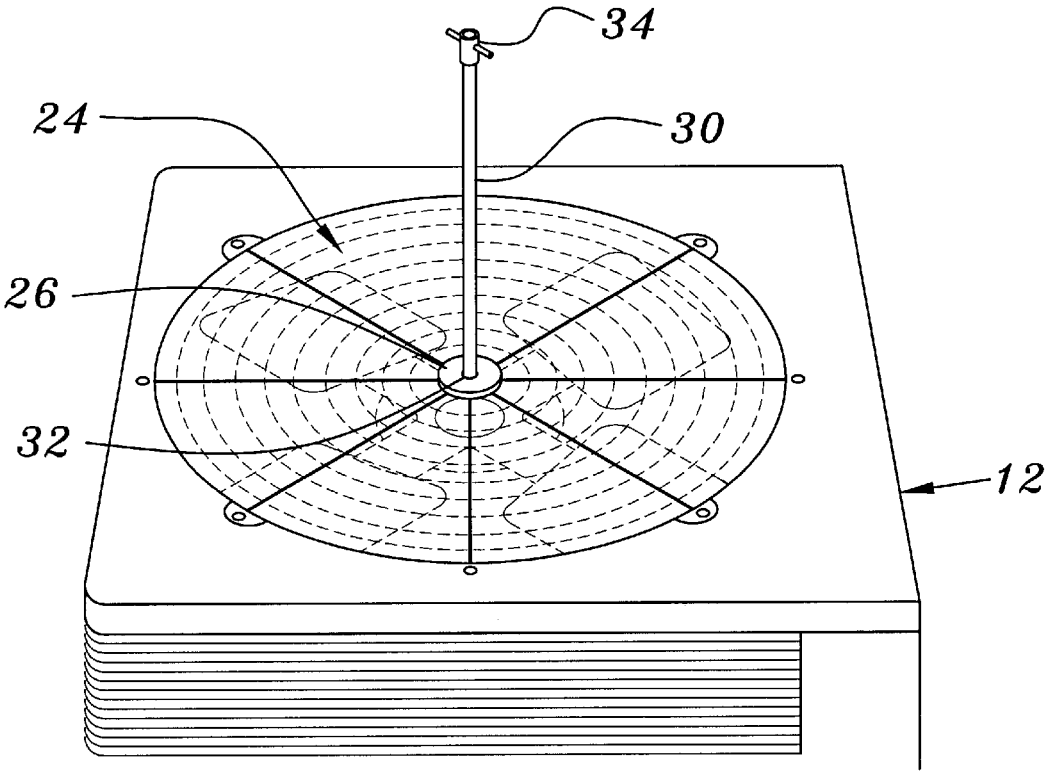
FIG. 4 is an upper perspective view of the outdoor air conditioning housing having the second embodiment of the damper of the invention magnetically coupled thereto.
Figure 5:
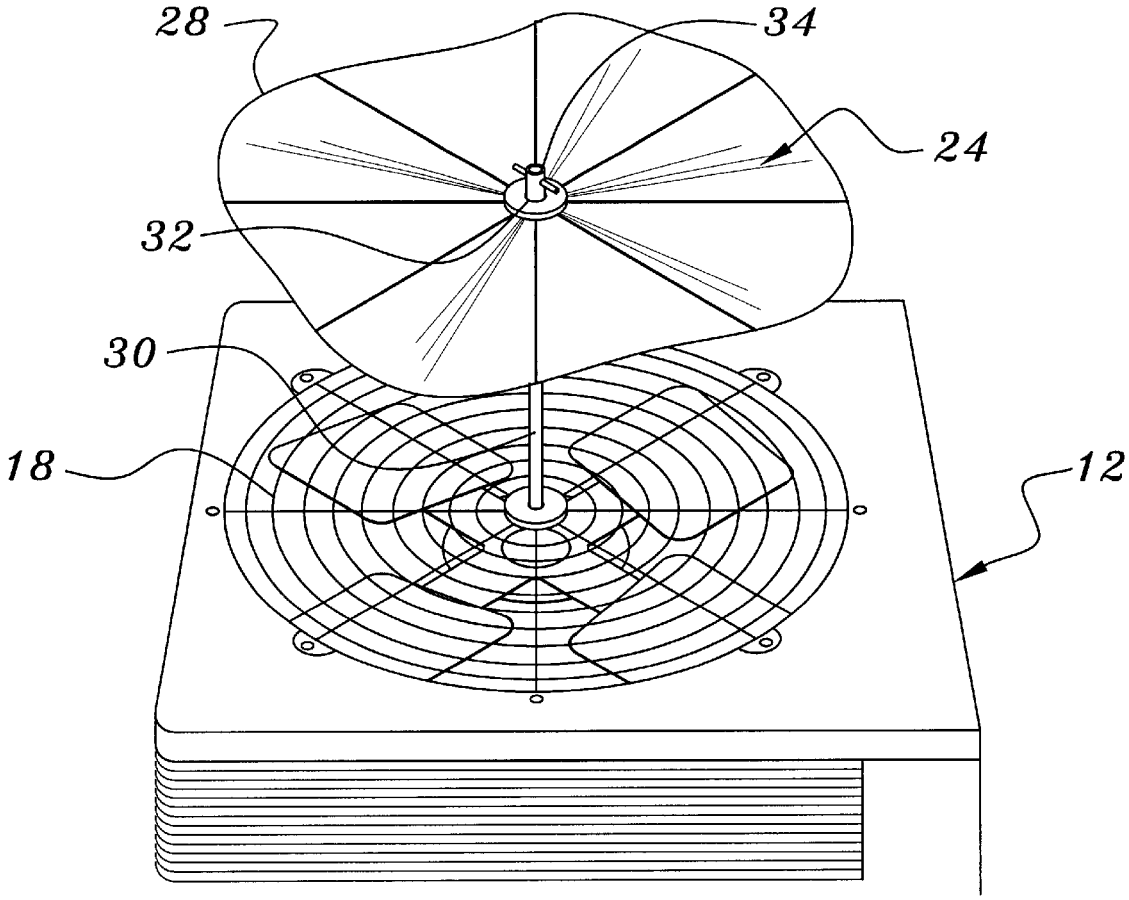
FIG. 5 is an upper perspective view of FIG. 4 showing the air damper of the invention slid upwardly along the upstanding rod caused by the upward flow of air produced by the blower assembly.
Figure 6:
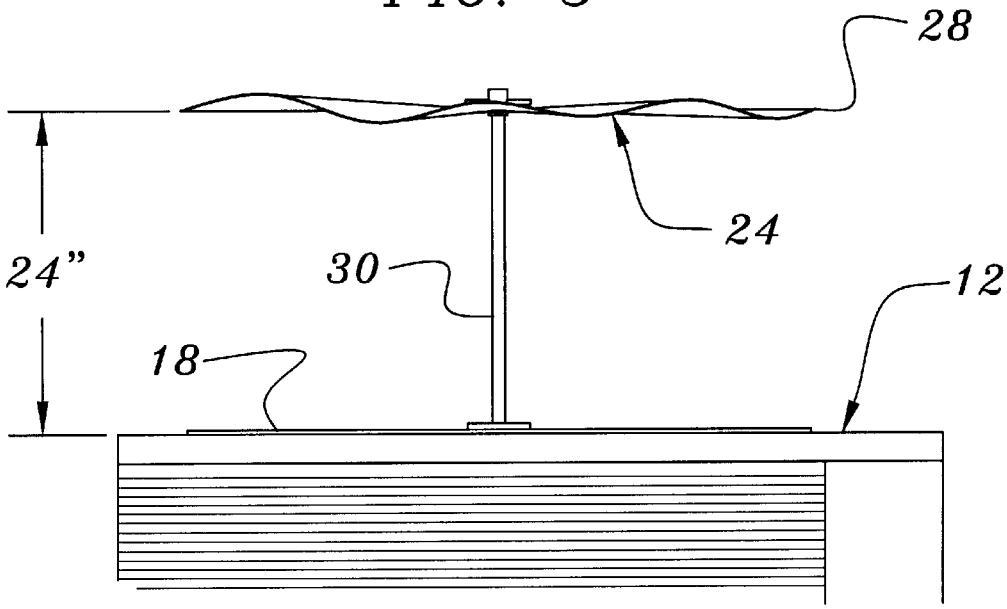
FIG. 6 is a side elevational view of FIG. 5.

The second embodiment of the damper 24 is illustrated in FIGS. 4–6. As best shown in FIG. 4, an upstanding rod 30 is mechanically coupled to the magnet 26 such as by a threaded boss or an adhesive. The magnet 26 is then directly magnetically coupled to the center plate 22 such that the upstanding rod 30 extends upwardly from the upper surface of the housing 12 from the center plate 22. In the second embodiment. damper 24 includes a center hole 32 of a diameter slightly greater than the diameter of the upstanding rod 30. During assembly, the center hole 32 of the damper 24 is aligned with the uppermost end of the upstanding rod 30 and slid downwardly to fully cover the grillwork 18 as in the case of the first embodiment. The uppermost end of the upstanding rod is then threaded with an enlarged stop 34.

As shown in FIGS. 5 and 6, the resulting upward flow of air produces lift under the damper 24 causing it to slide upwardly along the upstanding rod 30 until stopped by the enlarged stop 34 at the uppermost end of the upstanding rod 30. As in the case of the first embodiment, the periphery 28 of the damper 24 may flutter further upwardly as a result of the air flow against the undersurface thereof.

As soon as the blower assembly 14 ceases operation and the air flow likewise ceases, the lift produced thereby on the damper 24 likewise ceases. The damper 24 thus gently floats downwardly along the upstanding rod 30 to return to its covering position about the grillwork 18 (see FIG. 4). In this covering position, the damper 24 prevents debris from falling through the grillwork 18 and into the housing 12 of the air conditioning system 10.

The above-described second embodiment of the invention is preferred over the first embodiment due to its ability to float upwardly along the upstanding rod 30. With the rod 30 having a length of approximately two feet, it has been found that the air flow is virtually unrestricted. The efficiency of the air conditioning system is not compromised.

In both embodiments of the damper 24 of the invention, the damper 24 is only magnetically coupled to the grillwork 18. Hence, the damper 24 may be quickly and easily removed by removing the magnet 26 from the center plate 22 of the grillwork 18. In this regard, it is noted that the magnetic coupling force between the magnet 26 and the center plate 22 is designed to be sufficient to secure the damper 24 in position during operation of the blower assembly 14 while still allowing it to be easily removed by the homeowner without tools. Thus, the damper 24 of the invention is made to be easily installable and otherwise portable.

Finally, it is noted that the above descriptions have referred to the system as constituting an air conditioning system. However, it shall be appreciated that the damper 24 of the invention is equally adaptable systems that comprises a conventional heat pump system that may alternatively operate in a heating mode during winter months and in a cooling mode during summer months.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described.

What is claimed is:

1. A damper assembly for an outdoor housing containing a blower assembly protected by a grillwork that produces an upward air flow, comprising in combination:

a damper;

a magnet for magnetically coupling said damper to the grillwork;

the magnet being positioned in a center of the damper for magnetically coupling the center of the damper to a center of the grillwork; and said damper being comprised of a flexible material such that an outer periphery of the damper is caused to flex upwardly by the air flow.

2. A damper assembly for an outdoor housing containing a blower assembly protected by a grillwork that produces an upward air flow, comprising in combination:

a damper;

a magnet for magnetically coupling said damper to the grillwork;

an upstanding rod affixed to said magnet; and said damper including a hole allowing said damper to slide downwardly along the length of said upstanding rod to cover the grillwork and, during operation of the blower assembly to slide upwardly along the length of the upstanding rod by the air flow.

3. A damper assembly for use in conjunction with an air conditioning system having a blower assembly that is protected by a grillwork. the damper assembly comprising:

a damper sheet constructed from a fiberglass screening material and dimensioned to fit over the entire grillwork of the air conditioning system, the damper sheet having an outer peripheral edge and a centrally located hole;

a rod having a first end magnetically coupled to a central portion of a grillwork and a second end to which is threadably secured an enlarged stop, the damper sheet being secured along the length of the rod by way of the central hole, with the hole being dimensioned to allow the damper sheet to freely travel along the length of the rod and with the enlarged stop preventing the damper sheet from sliding off the second end of the rod;

the damper sheet having a first covering position wherein the blower assembly is not in operation and wherein air flow is not directed through the grillwork, the damper sheet also having a lifted position which is the result of an upward flow of air from the blower assembly whereby the damper is caused to slide upwardly along the rod until stopped by the enlarged stop and wherein the periphery of the damper sheet is caused to flutter further upwardly as a result of air flow against an under surface of the damper sheet.

4. A damper assembly for use in conjunction with an air conditioning system having a blower assembly, the damper assembly comprising in combination:

a damper sheet constructed from a fiberglass screening material which is magnetically interconnected to the air conditioning system;

the blower assembly being protected by a grillwork and the damper sheet is dimensioned to fit over the entire grillwork; and the damper sheet having a first covering position wherein the blower assembly is not operational, the damper sheet also having a lifted position which is the result of an upward flow of air from the blower assembly and wherein the periphery of the damper sheet is caused to flutter further upwardly as a result of air flow through the grillwork against an undersurface of the damper sheet.

5. A damper assembly for use in conjunction with an air conditioning system having a blower assembly, the damper assembly comprising in combination:

a damper sheet removably interconnected to the air conditioning system;

the damper sheet having a first covering position wherein the blower assembly is not operational, the damper sheet also having a lifted position which is the result of an upward flow of air from the blower assembly and wherein the periphery of the damper sheet is caused to flutter further upwardly as a result of air flow against an undersurface of the damper sheet; and the damper sheet being interconnected to the air conditioning system by way of a rod having a first end removably interconnected to the air conditioning system and a second end with an enlarged stop, and wherein the damper sheet is secured along the length of the rod by way of a central hole.

6. The damper assembly as described in claim 5 wherein the first end of the rod is magnetically interconnected to the air conditioning system.

* * * * *